US005148866A

United States Patent [19]

Greenlee

[11] Patent Number: 5,148,866

[45] Date of Patent: Sep. 22, 1992

[54] WELL TOOL ANCHORING MECHANISM WITH IMPROVED SLIP RELEASE

[75] Inventor: Donald R. Greenlee, Cedar Hill, Tex.

[73] Assignee: Dresser Industries, Inc., Dallas, Tex.

[21] Appl. No.: 767,174

[22] Filed: Sep. 27, 1991

[51] Int. Cl.[5] ..... E21B 33/129; E21B 23/06

[52] U.S. Cl. ..... 166/134; 166/140; 166/216; 166/217

[58] Field of Search ..... 166/140, 139, 138, 216, 166/217, 134

[56] References Cited

U.S. PATENT DOCUMENTS 3,356,141 12/1967 Kline ..... 166/134
3,416,608 12/1968 Crow et al. ..... 166/140 X
3,845,816 11/1974 Pitts ..... 166/134 X
4,427,064 1/1984 Boyer ..... 166/217
4,813,486 3/1989 Wyatt et al. ..... 166/217 X

*Primary Examiner*—Hoang C. Dang

[57] ABSTRACT

A releasable boring mechanism for releasably securing a tool downhole in a well includes upper and lower sets of slip expandable radially outward from retracted positions into extended positions for engagement with the inside wall of a well casing when a mandrel attached to a tubing string casing, the anchoring mechanism is lifted to wedge upper and lower frustoconical heads between the mandrel and the slips. In releasing the slips from the well casing, the lower edge of a window in an upper slip cage first engages a primary release shoulder on the bottom of a first to release one of the slips to lift such slip through the application of compression forces from the casing well.

3 Claims, 3 Drawing Sheets

WELL TOOL ANCHORING MECHANISM WITH IMPROVED SLIP RELEASE

BACKGROUND OF THE INVENTION

1. Technical Field

This invention relates generally to a well tool such as retrievable packer which includes a slip mechanism adapted to anchor the tool within a well. In particular, the invention relates to an improvement in the slip mechanism to allow the well tool to be moved from its anchored location in the well.

2. Background Information

In one prior art arrangement disclosed in U.S. Pat. No. 3,356,141, upper and lower sets of slip assemblies are utilized to secure a packer in a selected location in a well. Specifically, a packer sealing element is located between the upper and lower sets of slips and is compressed to expand outwardly sealing against the inside wall of a well casing as the individual slips of each assembly are set. In setting the slips, upper and lower cone assemblies respectfully engage the individual slips wedging them outwardly as the cone assemblies are forced beneath the slips. During movement of the well tool in the casing, the upper and lower sets of slips are kept from being set by a J-slot latching mechanism which maintains a specified distance between the upper and lower sets of slips. To set the slips, the J-slot latching mechanism is released by manipulation of the tubing string. Then the lower cone is freed to slide beneath the lower set of slips as the tubing string carrying the tool is pushed downwardly in the well. This wedges the slips in the lower set outwardly and into anchoring engagement with the inside surface of the well casing. As the lower set of slips bite into the well casing, any further downward movement of the tool in the well is prevented and the sealing element of the packer is compressed expanding radially outwardly to seal against the casing. Concurrently, the upper cone is wedged beneath the upper set of slips forcing each of the slips in the upper set radially outwardly to anchor in the inside wall of the casing so that the packer is held against movement either upwardly or downwardly within the well.

In order for the upper set of slips to be wedged outwardly and into the casing, the slips are carried individually within a housing which in turn is slidably mounted on a mandrel. Specifically, each of the upper slips is connected to the housing by way of a neck portion and at the upper end of the neck portion, each of the slips includes a circumferentially extending T-shaped shoulder. The latter extends in opposite directions over forked arms of the housing and supports the slip loosely on the housing with a gripping segment of each slip depending freely from the underside of the housing.

To move the tool within the well, an abutment is carried on the mandrel and when the tubing string is pulled upwardly the mandrel abutment engages the housing pulling the housing upwardly. In turn, the forked arms of the housing act against the T-shaped shoulders of the slips sliding each of the slips in an unwedging direction relative to the cone and away from anchoring against the inside wall of the casing.

To facilitate releasing the slips from the casing, the neck portion of an initial released one of the slips is shorter than the others. As a result, initial movement of the housing when lifted by the abutment causes the slip lifting forces to be concentrated on the shorter neck slip freeing the shorter neck slip before the others.

With slip releasing mechanisms of the forgoing described type, problems have been encountered in the past when the yield strength of the neck portion of any of the slips is exceeded without the slip being released. Once the neck on a slip breaks, then the slip may become jammed between the cone and the casing making it virtually impossible to remove the packer from the casing even to the extent it may become necessary the drill the jammed packer out of the well.

SUMMARY OF THE INVENTION

The present invention aims to avoid the foregoing problem by lifting the initial release slip from below the slip rather than from above. More specifically, this is accomplished through the provision of a plurality of annularly spaced slip windows in an upper housing or slip cage and utilizing the lower edges of one of the windows to engage the bottom edge of the initial release slip and lift the slip from gripping engagement with the casing wall.

Invention also resides in the utilization of a primary release shoulder on the initial release slip below the gripping teeth of the slip in conjunction with an edge surface which is carried by the mandrel from below the initial release slip and into abutting engagement with the primary release shoulder of the slip in order to release the slip.

Still further invention resides in the provision of a plurality of circumferentially spaced slots in the upper slip cage above the windows with a secondary release shoulder formed on the initial release slip above the gripping teeth. The secondary release shoulder extends through the slot for engagement by the lower ledge of the slot when deformation occurs between the window edge and the primary release shoulder so that additional lifting is applied to the initial release slip.

The foregoing and other advantages of the present invention will become more apparent from the following description of the preferred embodiment when taken in conjunction with the accompanying drawings.

BEST MODE FOR CARRYING OUT THE INVENTION

Figure 1A:
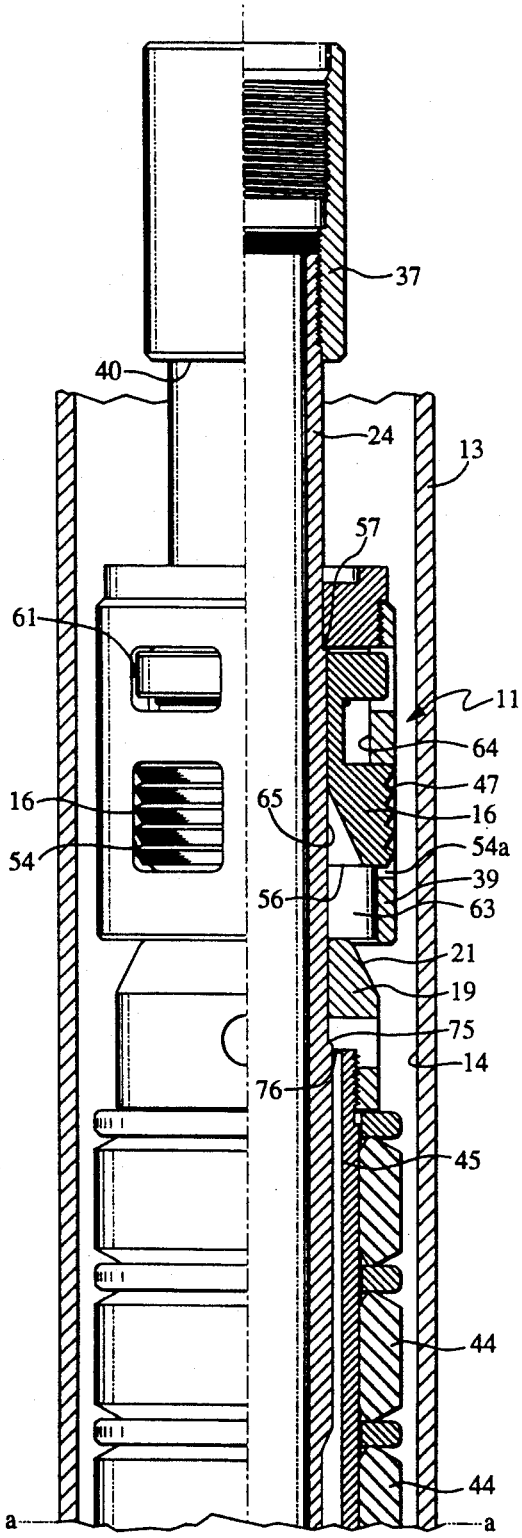
FIGS. 1*a* and 1*b* taken together along line a—a are a combined elevational and cross-sectional view of a well tool embodying the novel features of the present invention with parts of the tool shown assembled at an intermediate stage of actuation to anchor against the well casing.

As shown in the drawings for purposes of illustration, the present invention is embodied in a well tool in the form of a packer 10 particularly adapted to be releasably anchored within a well by a slip mechanism 11. Herein, the packer is connectable within a tubing string (not shown) which may be manipulated vertically within a well to set and release the packer from an anchored position against a well casing 13. In setting the packer within the well and against the inside wall 14 of the casing, a releasable friction latch mechanism 15 (see FIG. 1*b*) mounted on the lower end of the packer is first released to enable upper and lower sets of slips 16 and 17 to be deployed to embed in the casing. Upper and lower setting heads 19 and 20 which include frustoconical wedge surfaces 21 and 22, respectively, are wedged between a tubular mandrel 24 and the slips to move the slips radially outwardly against the well casing. Once set, the upper set of slips 16 reacts against forces directed upwardly against the packer while the lower set of slips 17 reacts against forces directed downwardly against the packer so that the packer is thus held against movement in either vertical direction in the well.

Figure 3:
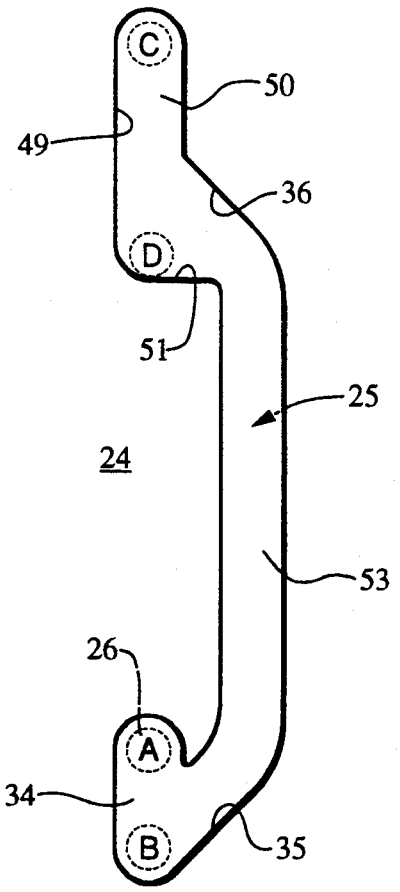
FIG. 3 is a schematic enlargement of a portion of a J-slot and pin mechanism employed in the exemplary tool of the present invention with the sequence of different pin positions indicated for when setting of the tool in a selected position the well.
Figure 4:
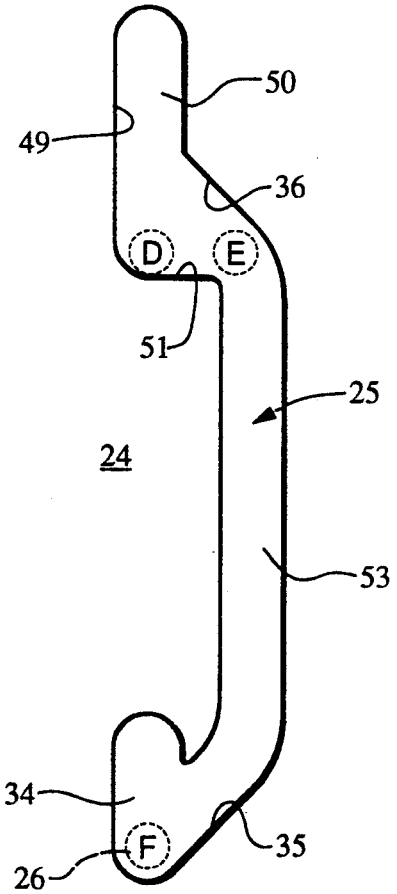
FIG. 4 is a schematic enlargement similar to FIG. 3 but showing the sequence of different pin positions for when releasing the tool from its set position in the well.

The friction latch mechanism 15 serves to hold the components of the packer 10 and the upper and lower sets of slips 16 and 17 as an elongated assembly for being lowered into the well. Specifically, the mechanism 15 includes a J-slot 25 formed within the surface of the mandrel 24 and a gudgeon pin 26 extending into the slot from a threaded connection to a housing 27. The housing is part of a lower anchor cage 29 for the lower set of slips 17 and includes four friction pads 30 connected by means of friction springs 31 within an annular recess 33 formed in the lower end portion of the housing. Details of the shape of the J-slot are shown in FIGS. 3 and 4 with various positions of the gudgeon pin 26 shown in phantom. For running the tubing string carrying the packer 10 into the well, the gudgeon pin 26 is located at the top of the hook 34 of the J-slot as indicated by the position A. In this position, the components of the packer and slip anchoring mechanism are stretched out along the mandrel. In particular, the mandrel is kept from moving downwardly in the lower anchor cage 29 and causing the lower set of slips 17 to be set.

As a first step in setting the anchoring mechanism 11, it is necessary to pull up slightly on the tubing string. This shifts the gudgeon pin from the A position to the B position (shown in FIG. 1 also) allowing the lower anchor cage 29 to be unlatched from its run-in position for shifting into its set position. While pulling up, the mandrel 24 is rotated in a clockwise direction by torquing on the tubing string and while continuing to torque the mandrel in a clockwise direction the tubing is pushed downwardly in the well. This causes the gudgeon pin 26 to follow along the two slanted back edges 35 and 36 of the J-slot 25 (see FIG. 3) eventually to the top of the slot at position C. The friction mechanism 15 supports the lower cage 29 against movement relative to the casing 13, so that the mandrel 24 slides downwardly within the lower cage as the tubing string is lowered within the well. As the mandrel is lowered within the lower cage, the packer assembly 10 and lower setting head 20 also slide downwardly with the mandrel and the frustoconical setting surface 22 of the lower head wedges behind the lower slips 17 and forces such slips radially outward into initial anchoring engagement with the casing wall 14.

Figure 5:
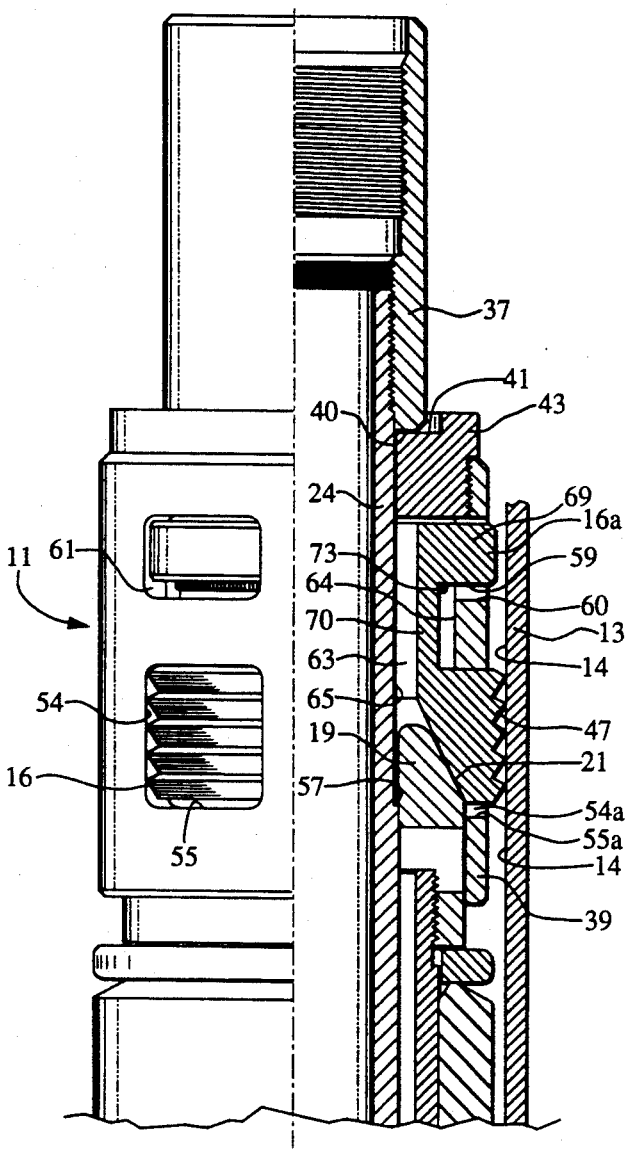
FIGS. 5 and 6 are enlarged cross-sectional views of a portion of the well tool showing respectively, setting and initially releasing the upper set of slips.

At the same time that the lower set of slips 17 is initially set, an upper mandrel coupling 37 for the connection to the tubing string, engages an upper slip cage 39 sliding it downwardly onto the upper setting head 19 for setting the upper slips 16. As shown in FIG. 5, a lower face 40 of the coupling 37, abuts the top 41 of an upper slip support 43 to force the upper slip cage 39 to be driven downwardly onto the upper setting head 19 as the tubing string is lowered. The frustoconical surface 21 of the upper setting head wedges the upper slips 16 radially outwardly and into initial anchoring engagement with the inside wall 14 of the casing 13. With further downward movement of the tubing string, resilient sealing elements 44 (see FIG. 1) carried on a packer shell 45 are compressed and more tightly wedge the lower setting head 20 against the lower slips 17. This occurs because teeth 46 on the outer surface of the lower slips are designed to anchor against the application of downwardly directed forces to the anchoring mechanism. On the other hand, teeth 47 on the outer surface of the upper slips 16 are designed to anchor against the application of upwardly directed forces. Thus, as the packer sealing elements are compressed by setting down on the tubing string, the lower slips are anchored more tightly against the inside wall of the casing while the upper slips may slide downwardly scraping against the inside wall of the casing.

To insure that the lower set 17 of slips is set as tightly as desired against the casing wall 14, an upwardly directed force is applied to the lower set of slips tending to pull the lower slips upwardly toward the sealing elements 44 of the packer 10. This is accomplished by simultaneously lifting the tubing string and applying an amount of counterclockwise torque sufficient to bias a wall 49 (see FIG. 3) of the upper end portion 50 of the J-slot 25 toward the gudgeon pin 26. The tubing is then lifted pulling a tension shoulder 51 upwardly against the gudgeon pin as shown in position D of FIG. 3 for force to be transmitted upwardly through the gudgeon pin so as to further compress the packer elements 44 and finally set the upper slips 16 as the lower slips 17 may scrape along the surface of the inside wall 14 of the casing 13.

To release the slip mechanism 11, the tubing string is rotated in a clockwise direction and lifted. This causes the mandrel 24 to move, shifting the tension shoulder 51 (see FIG. 4) from beneath the gudgeon pin 26 and aligning the pin with an elongated center portion 53 of the J-slot (shown as position E in FIG. 4). As the mandrel 24 is then pulled upwardly, the gudgeon pin effectively moves downwardly within the J-slot 25 ultimately into position F and as the gudgeon pin rides downwardly within the J-slot, the upper slips 16 are released.

In accordance with the principle aim of the present invention, the upper slip cage 39 is uniquely constructed so as to avoid breaking off an initial release slip 16*a* above the teeth 47 when pulling on the tubing string to release the well tool 10 from its anchored location against the well casing 13. For this purpose, the upper slip cage includes a plurality of windows 54 through which the slips 16 extend when anchored against the casing. For an initial release slip 16*a*, a lower edge 55*a* of the window is located beneath a primary release shoulder 56 located on the slip beneath the teeth 47. In comparison to the lower edges 55 of the other windows, the space between the primary release shoulder 56 and the lower edge 55*a* is smaller so that the lower edge 55*a* of the initial release slip window 54*a* engages the primary release shoulder 56 of the initial release slip sequentially first. As a result, when the slip 16*a* is released, the forces acting across such slip are primarily in compression rather than in tension so that the slip is substantially less likely to be broken and the well tool is much less likely to become jammed within the well.

Figure 2:
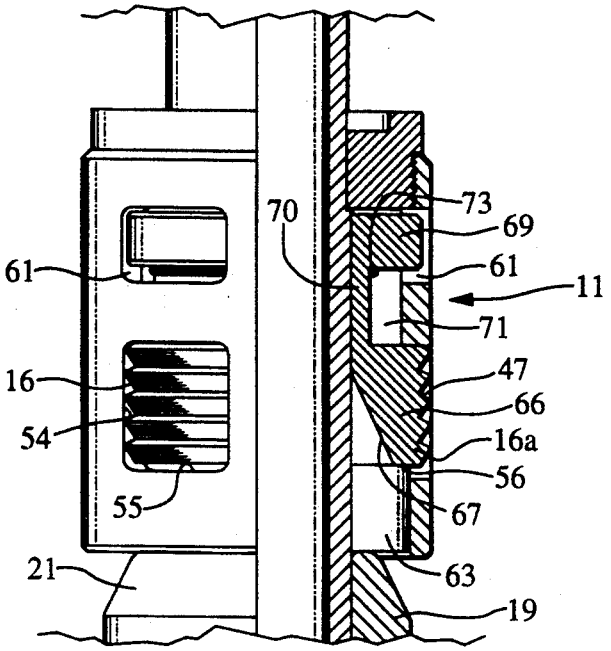
FIG. 2 is a view similar to FIG. 1 but with a section of the tool shown enlarged for clarity of illustration.

In the present instance, the upper slip cage 39 comprises an annular housing with three of the windows 54 opening through the housing at equally spaced circumferential positions. The windows each open into an annular cavity 63 defined between the inside wall 64 of the housing and the outside surface 65 of the mandrel 24. Also found within the housing are three similarly spaced slots 61 located directly above the windows and extending through the housing. The windows and slots are provided in pairs, one for each of the upper slips 16. As shown in FIG. 2, each of the slips 16 includes a lower wedge portion 66 upon which the teeth 47 are formed on the outer surface thereof and upon which an inner frustoconical surface 67 is formed for complimentary mating with the frustoconical surface 21 of the upper head 19. For each upper slip this lower wedge portion is in registry with an associated one of the windows so as to be able to move radially between retracted and extended positions for being releasably anchored against the well casing 13. Additionally, each slip includes an enlarged upper end portion 69 connected by a narrower intermediate portion 70 so that a radially outward facing recess 71 is found in the intermediate portion of each slip 16. Connecting together each of the upper slips is an annular retractor spring 73 captured within the outwardly facing recess 71 of the slips. The spring serves to bind the slips together and, when the slips are all released from the wall casing, the retractor spring 73 pulls the slips radially into the upper cage 39 with the inward side of the slips being urged against the outside of the mandrel 24.

Figure 6:
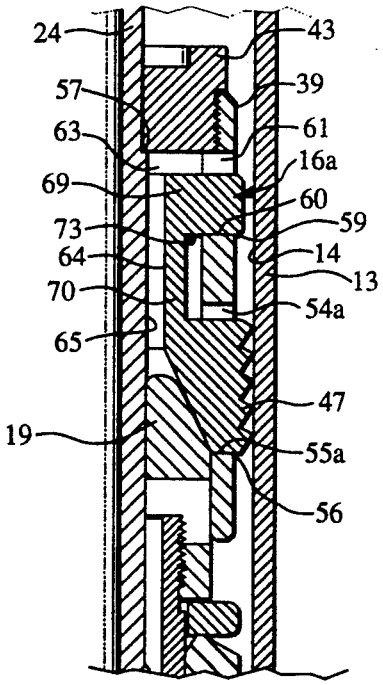

In releasing the upper slips 16, the upper slip cage 39 is lifted upwardly and away from the upper setting head 19 by a lifting shoulder 57 (see FIGS. 5 and 6) which is carried with the mandrel 24 when raised with the tubing string. As shown more particularly in FIG. 5, the lifting shoulder 57 is located on the mandrel below the upper mandrel coupling 37 and first engages the underside of the upper slip support 43 to lift the upper cage 39 away from the upper setting head 19. As the upper cage moves, the primary release shoulder 56 of the first releasing one 16*a* of the upper slips 16 is contacted by the lower edge 55*a* of its slip window 54*a*, lifting and camming the slip 16*a* from anchored engagement with the inside wall 14 of the casing 13 (see FIG. 6). This occurs as the upper side of the teeth 47 slide across the indentations made in the inside wall of the casing.

Figure 1B:
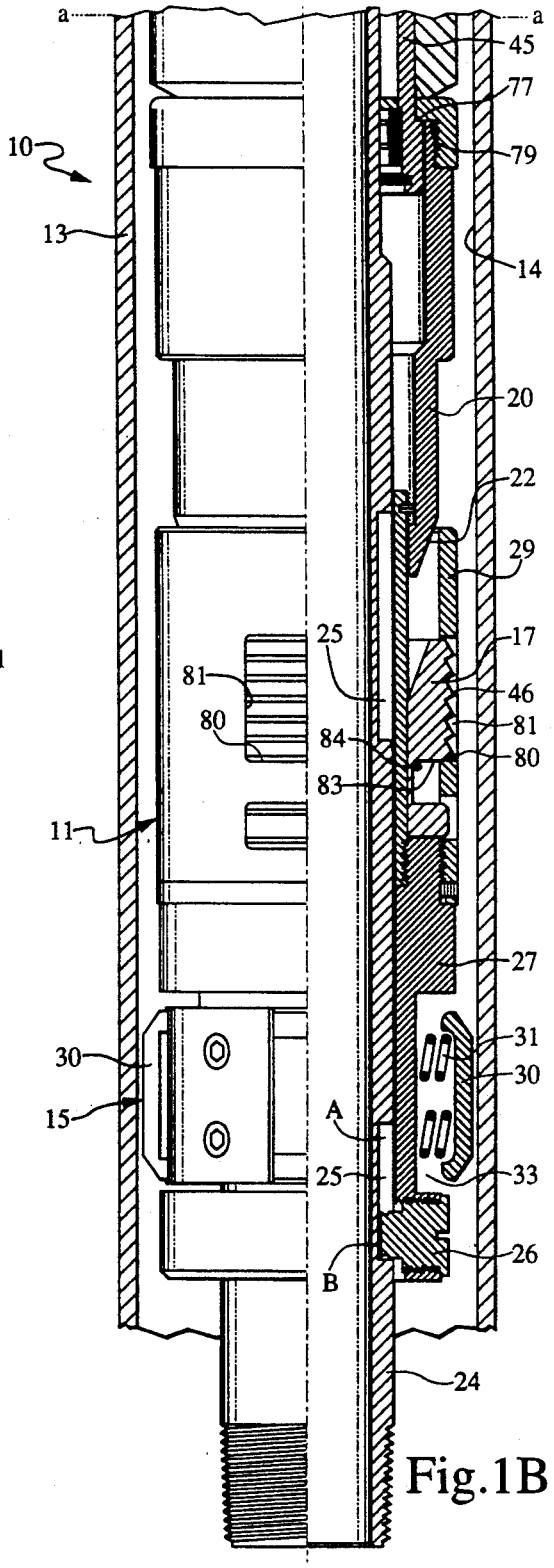

In the event of metal deformation between the primary release shoulder 56 of the first releasing slip 16*a* and the window edge 55*a*, a secondary release shoulder 59 formed on the underside of the enlarged upper end portions 69 of the slip is engaged by a ledge 60 of slot 61. This distributes the force applied in dislodging the first releasing slip 16*a* between both the primary and secondary releasing shoulders 56 and 59 to further reduce the likelihood of breaking the first releasing slip 16*a*. Thereafter, the remaining upper slips 16 are dislodged by the edges 55 of their respective windows 54 as the upper cage 39 is lifted further. As the upper slips are dislodged, the upper retractor spring 73 pulls the slips into their retracted positions as shown in FIGS. 1 and 2, and the compressed packer elements 44 relax. This occurs as an upper head support shoulder 75 (see FIG. 1*a*) engages an inside shoulder 76 on upper head 19 as the mandrel 24 is slid upwardly. This in turn lifts and carries the packer shell 45 so as to slide upwardly within the packer elements 44 until a lower head lifting shoulder 77 (see FIG. 1*b*) on the shell abuts a thimble shoulder 79. The latter lifts and carries the lower setting head 20 upwardly away from wedging engagement with the lower slips 17. The lower head is pulled upwardly away from the lower slips until the J-slot 25 bottoms out against the gudgeon pin 26 in the position F shown in FIGS. 1*b* and 4.

Once the gudgeon pin 26 is located in position F at the bottom of the J-slot 25 and with further upward movement of the mandrel 24, lifting forces are transmitted through the gudgeon pin to the lower slip cage 29. In turn, the cage transmits lifting forces to the lower slips 17 by engagement of lower edges 80 of slip openings 81 against the undersides of shoulders 83 of lower slips 17. With the lower setting head 20 having been lifted from wedging engagement with the lower slips, the action of the window edges 80 against the shoulders serves to dislodge the lower slips 17 from anchored engagement with the inside wall 14 of the casing 13. Once loosened, the lower slips are retracted by the action of a lower release spring 84. Thereafter, the well tool 10 and slip mechanism 11 are free to be retrieved or moved and anchored in another location within the well.

Thus, it is seen from the foregoing that the present invention brings to the art a unique slip mechanism 11 particularly adapted for releasing the slips 16 utilized to hold the tool 10 in the well to avoid breaking the initially released slip 16*a* and causing the tool to become jammed within the well. This is accomplished by virtue of the provision of the windows 54 in the upper slip cage 39 so that the lower edge 55*a* of the window containing the first releasing slip 16*a* engages the bottom of the slip to apply compression forces to release the slip rather than tension forces.

I claim:

1. In a well tool with a set of slips carried within a cage slidably mounted on a mandrel for said slips to move within said cage radially from retracted positions into radially extended positions by the wedging action of a frustoconical setting head sliding between the mandrel and the slips so as to force the latter to gripping engagement with the inside of a well casing to anchor the tool against upwardly acting forces in the well, and a shoulder on said mandrel engageable with said cage to lift said cage off said setting head for releasing said slips to free the tool for upward movement within the well, the improvement comprising a plurality of windows formed within said cage and spaced circumferentially from each other around said mandrel, said slips protruding through said windows for movement between said retracted and extended positions with each of said slips having a toothed outer surface for gripping engagement with the casing wall and a primary release shoulder formed thereon beneath said toothed outer surface, said windows each including a lower edge engageable with said primary release shoulder when said cage is lifted by said shoulder on said mandrel and in turn lifting said slips free from said casing wall for movement into said retracted positions, and a plurality of circumferentially spaced slots formed through said cage with one each of said slots being associated with and located above each of said windows, each one of said slips including a secondary release shoulder formed thereon above said toothed outer surface and projecting in a radial direction outwardly from said cage into the one of said slots associated with said one slip, said slots further each having a lower ledge spaced from the edge of the one of said associated windows a selected distance whereby said ledge engages said secondary release shoulder in the event of deformation occurring between said primary release shoulder and said lower edge when pulling said mandrel upwardly to release said slips.

2. An apparatus for releasably anchoring a device in a tubing string to the wall of a well casing against vertical movement in a well, said apparatus including, a mandrel having upper and lower ends adapted for connection within the tubing string, a generally cylindrical upper slip cage telescoped on said mandrel and slidable thereon between release and set positions, an annular cavity defined within said cage adjacent said mandrel and a plurality of circumferentially spaced windows extending through said cage and opening radially outward from said cavity, a plurality of upper slips supported within said cavity in said upper slip cage, said upper slips being arcuately spaced from each other circumferentially around said mandrel with one each of said slips being associated with one of said windows and protruding therefrom for radial movement between an extended position for gripping against the casing wall and a retracted position released from griping engagement with the casing wall, a retractor acting against said upper slips and urging said upper slips into their retracted positions, a generally cylindrical lower slip cage telescoped on said mandrel and spaced below said upper slip cage, an annular recess defined within said lower slip cage adjacent said mandrel and a plurality of circumferentially spaced openings extending through said lower slip cage and communicating radially outward from said recess, a plurality of lower slips supported within said recess in said lower slip cage, said lower slips being arcuately spaced from each other circumferentially around said mandrel with one each of said lower slips being associated with one of said openings for radial movement between an extended position for gripping against the casing wall and a retracted position released from griping engagement with the casing wall, a releaser acting against said lower slips and urging said lower slips into their retracted positions, a J-slot friction mechanism releasably latched between said lower slip cage and said mandrel for frictionally connecting said lower slip cage in a selected vertical position against the casing wall to allow said mandrel to be slid within said lower slip cage between setting and release positions, upper and lower setting heads carried on said mandrel between said upper and lower slip cages and engageable with said upper and lower slips, respectively, to wedge said slips radially outward into gripping engagement with said casing wall when said J-slot mechanism is released and said mandrel is slid downwardly in said upper and lower slip cages by setting down on said tubing string, resilient means compressible between said upper and lower setting heads and acting to urge said heads away from each other when said heads are wedging said slips into gripping engagement with the casing wall, a connection acting between said mandrel and said upper slip cage for lifting said upper slip cage with said mandrel and away from said upper head when said mandrel is raised to release said upper and lower slips from gripping engagement with the casing wall, said upper slips each having a toothed outer surface for gripping engagement with the casing wall against relative upward movement between said upper slips and said casing when said upper slips are set, said upper slips each further including a primary release shoulder formed thereon beneath said toothed outer surface, said circumferentially spaced windows each including a lower edge engageable with said primary release shoulder of said associated upper slip for said lower edge to abut and lift said associated upper slip from gripping engagement with the casing wall when lifting said mandrel, and a plurality of circumferentially spaced slots formed through said upper cage with one each of said slots being associated with and located above each of said windows, each one of said upper slips including a secondary release shoulder formed thereon above said toothed outer surface and projecting in a radial direction outwardly from said recess into the one of said slots associated with said one upper slip, said slots further each having a lower edge spaced from the edge of the one of said associated windows a selected distance whereby said ledge engages said secondary release shoulder in the event of deformation occurring between said primary release shoulder and said lower edge when pulling said mandrel upwardly to release said upper slips.

3. An apparatus for releasably anchoring a device in a tubing string to the wall of a well casing against vertical movement in a well, said apparatus including, a mandrel having upper and lower ends adapted for connection within the tubing string, a generally cylindrical upper slip cage telescoped on said mandrel and slidable thereon between release and set positions, said cage including a plurality of circumferentially spaced windows extending therethrough, a plurality of upper slips supported within said upper slip cage with one each of said slips being associated with one of said windows and protruding therefrom for radial movement between an extended position for gripping against the casing wall and a retracted position released from griping engagement with the casing wall, a retractor spring acting against said upper slips and urging said upper slips into their retracted positions, a generally cylindrical lower slip cage telescoped on said mandrel and spaced below said upper slip cage, said lower slip cage having a plurality of circumferentially spaced openings extending therethrough, a plurality of lower slips supported within said lower slip cage circumferentially around said mandrel with one each of said lower slips being associated with one of said openings for radial movement between an extended position for gripping against the casing wall and a retracted position released from griping engagement with the casing wall, a release spring acting against said lower slips and urging said lower slips into their retracted positions, a releasable latch mechanism acting between said lower slip cage and said mandrel and for supporting said lower slip cage to allow said mandrel to be slid therein between setting and release positions, upper and lower setting heads carried on said mandrel between said upper and lower slip cages and engageable with said upper and lower slips, respectively, to wedge said slips radially outward into gripping engagement with said casing wall when said releasable latch mechanism is released and said mandrel is slid downwardly in said upper and lower slip cages by setting down on said tubing string, resilient means compressible between said upper and lower setting heads and acting to urge said heads away from each other when said heads are wedging said slips into gripping engagement with the casing wall, a connection acting between said mandrel and said upper slip cage for lifting said upper slip cage with said mandrel and away from said upper head when said mandrel is raised to release said upper and lower slips from gripping engagement with the casing wall, said upper slips each having a toothed outer surface for gripping engagement with the casing wall against relative upward movement between said upper slips and said casing when said upper slips are set, said upper slips each further including a primary release shoulder formed thereon beneath said toothed outer surface, said circumferentially spaced windows each including a lower edge engageable with said primary release shoulder of said associated upper slip for said lower edge to abut and lift said associated upper slip from gripping engagement with the casing wall when lifting said mandrel, and a plurality of circumferentially spaced slots formed through said upper cage with one each of said slots being associated with and located above each of said windows, each one of said upper slips including a secondary release shoulder formed thereon above said toothed outer surface and projecting in a radial direction outwardly from the one of said slots associated with said one upper slip, said slots further each having a lower ledge spaced from the edge of the one of said associated windows a selected distance whereby said ledge engages said secondary release shoulder in the event of deformation occurring between said primary release shoulder and said lower edge when pulling said mandrel upwardly to release said upper slips.

* * * * *